United States Patent [19]

Nomura et al.

[11] Patent Number: 4,538,577

[45] Date of Patent: Sep. 3, 1985

[54] FUEL INJECTION APPARATUS FOR INTERNAL COMBUSTION ENGINE

[75] Inventors: Toshio Nomura, Niiza; Eiji Taguchi, Tokyo; Tomio Aoi, Omiya, all of Japan

[73] Assignee: Honda Giken Kogyo Kabushiki Kaisha, Tokyo, Japan

[21] Appl. No.: 131,133

[22] Filed: Mar. 17, 1980

[30] Foreign Application Priority Data

Mar. 22, 1979 [JP] Japan ..... 54-32220

[51] Int. Cl.[3] ..... F02M 39/00

[52] U.S. Cl. ..... 123/452; 123/463; 261/50 A

[58] Field of Search ..... 123/452, 453, 454, 455, 123/505, 463; 261/50 A

[56] References Cited

U.S. PATENT DOCUMENTS

| | | | |
|---|---|---|---|
| 2,785,669 | 3/1957 | Armstrong | 123/453 |
| 2,857,203 | 10/1958 | Korte | 123/453 |
| 3,543,739 | 12/1970 | Mennesson | 123/463 |
| 3,650,258 | 3/1972 | Jackson | 123/463 |
| 3,688,754 | 9/1972 | Eckert | 123/505 |
| 3,712,275 | 1/1973 | Jackson | 261/50 A |
| 4,050,431 | 9/1977 | Jackson | 123/463 |
| 4,143,631 | 3/1979 | Stumpp | 123/452 |
| 4,170,204 | 10/1979 | Bauder | 261/50 A |
| 4,175,528 | 11/1979 | Mennesson | 123/463 |
| 4,368,714 | 1/1983 | Emmenthal | 261/50 A |

OTHER PUBLICATIONS

"Cycle", Magazine, Apr., 1978, p. 122.

*Primary Examiner*—Carl Stuart Miller

*Attorney, Agent, or Firm*—Armstrong, Nikaido, Marmelstein & Kubovcik

[57] ABSTRACT

An intake passage for an internal combustion engine is provided on the downstream side of a throttle valve with a fuel injection nozzle connected through a fuel passage to a fuel pump and is additionally provided on the upstream side thereof with an air metering valve arranged to be turned towards its opening side according to increase in an intake negative pressure, and the fuel passage is provided with a fuel metering valve interposed therein. The fuel metering valve is formed into a slidable type spool valve, a valve body thereof is disposed in parallel with a valve body of the air metering valve and a lever is swingably supported at its middle portion and is in engagement at its one end with a cam mounted on a turning shaft of the air metering valve and is in engagement at its other end with a valve rod projecting from one end portion of the fuel metering valve.

2 Claims, 7 Drawing Figures air substantially in proportional to the intake negative pressure is effected.

Figure 1:
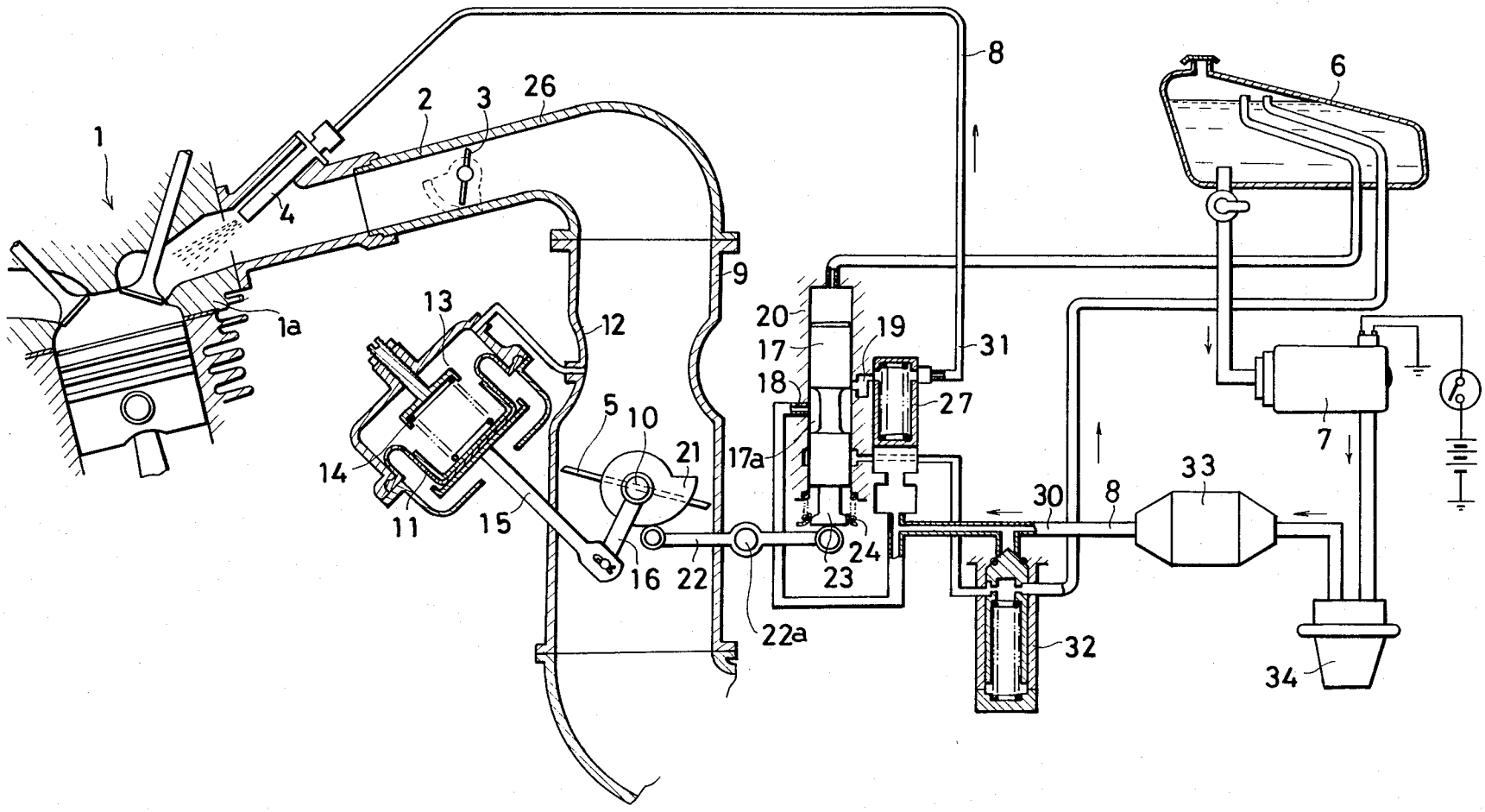

The fuel metering valve 17 is formed into a spool valve slidably mounted in a valve body 20 having an inlet opening 18 on one side and an outlet opening 19 on the other side, so that this makes it possible that the valve body 20 extending long along the slide movement direction of the spool valve 17 and the valve body 9 of the air metering valve 5 are arranged in parallel one with another, and the fuel metering valve 17 is given any desired metering movement according to a profile of the cam 21 through a lever 22 which is in engagement at its one end with the cam 21 mounted on the turning shaft 10 disposed at a right angle to the longitudinal direction of the valve body 9 of the air metering valve 5.

Figure 7:
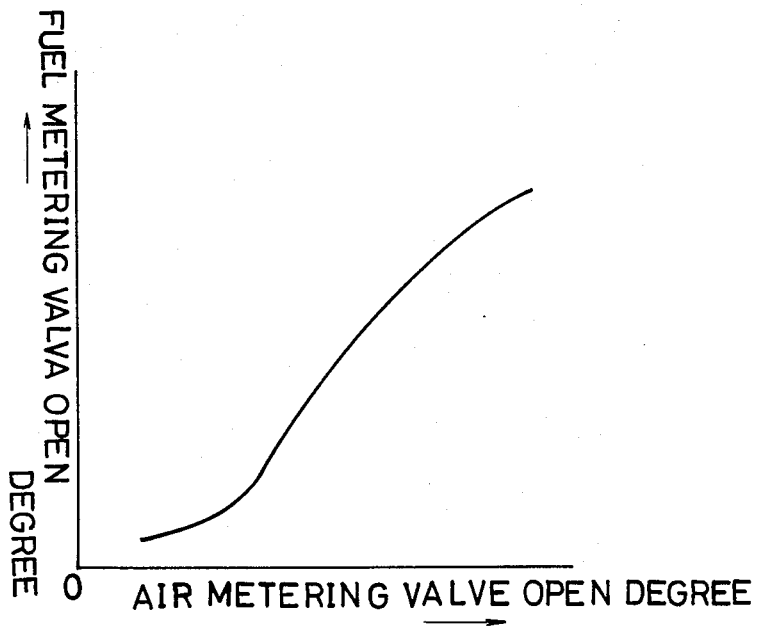

More in detail, the lever 22 is in engagement at its one end with the cam 21 and at its other end with a valve rod 23 projecting from one end portion of the fuel metering valve 17, and also the same is swingably supported at its middle portion on an intermediate pivot 22*a* so that by turning of the cam 21, the lever 22 may be given a swing movement, and its both ends more nearly along the longitudinal directions of the two valve bodies 9, 20 disposed in parallel one with another. Thus, if the air metering valve 5 is turned towards its opening side, the lever 22 is given a swing movement according to turning of the cam 21, and thereby the fuel metering valve 17 is moved to slide towards its opening side against the action of a return spring 24, so that an overlapped open degree made between an annular groove 17*a*, which is made in the valve 17, and an outlet opening 19, and accordingly, an amount of fuel passing therethrough is increased in accordance with the profile of the cam 21 as shown, for instance, in FIG. 7.

Figure 5:
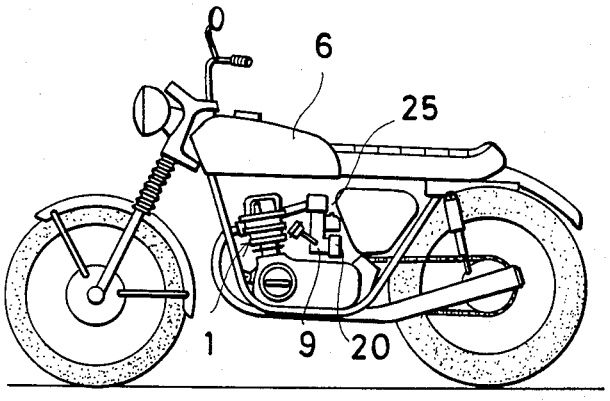
Figure 6:
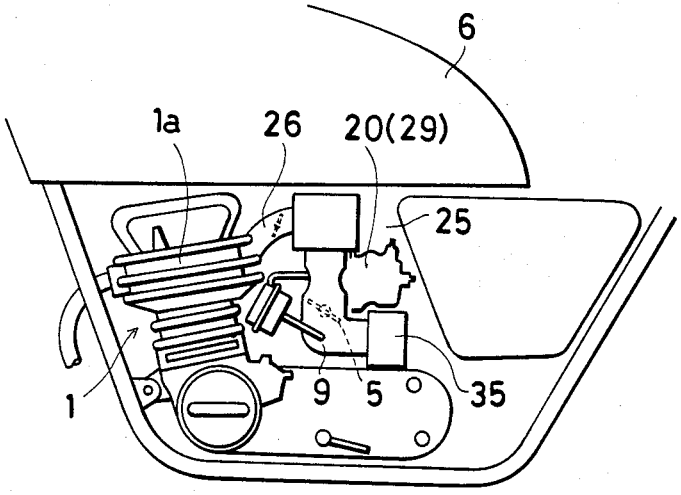

Thus, the apparatus can be decreased in space by arranging the valve bodies 9, 20 for the two metering valves 5, 17 in parallel one with another, so that this arrangement makes it possible that the apparatus is accommodated in a defined room space 25 formed behind the engine 1 on a motorized two-wheeled vehicle as shown, for instance, in FIGS. 5 and 6.

It is preferable in this case that the valve body 9 of the air metering valve 5 is so disposed as to extend upright along the side of the engine 1, and the valve body 9 is connected at its top portion through an intake manifold 26 to a top portion cylinder head 1*a* of the engine 1 with the shortest connecting length. As a result, the apparatus can become smaller in space.

Figure 4:
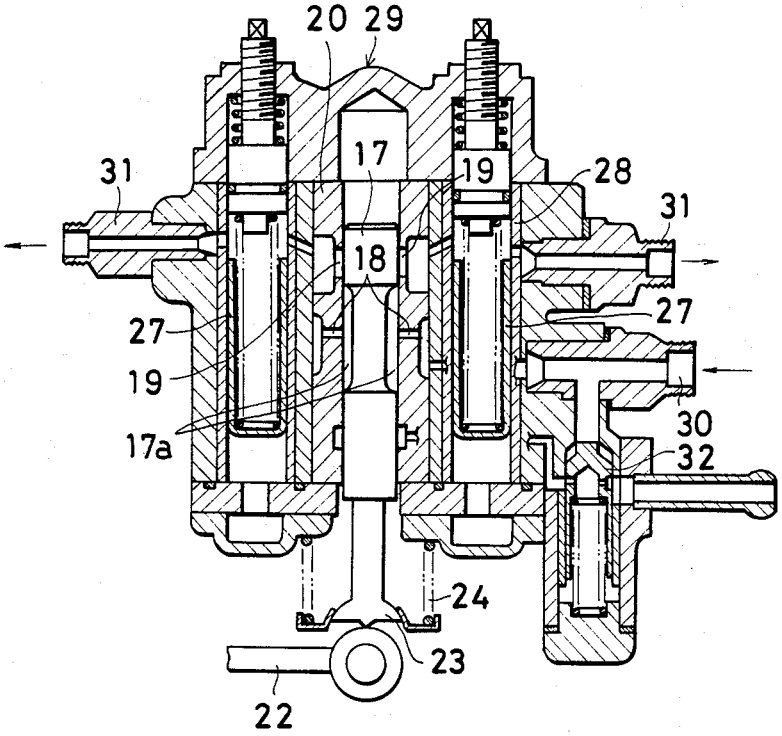

As shown in FIG. 4, the fuel metering valve 17 is so formed that the plural number of the outlet openings 19 corresponding to the number of cylinders of the engine 1 are formed in the valve body 20, and the difference in the fuel pressure between the inlet opening 18 and at the outlet opening 19 is adjusted to become constant by a constant differential pressure valve 27 connected to each of the outlet openings 19, and a valve body 28 of the constant differential pressure valve 27 and the valve body 20 of the fuel metering valve 17 are formed into an integral valve block 29, and the same is combined with the valve body 9 of the air metering valve 5.

Figure 2:
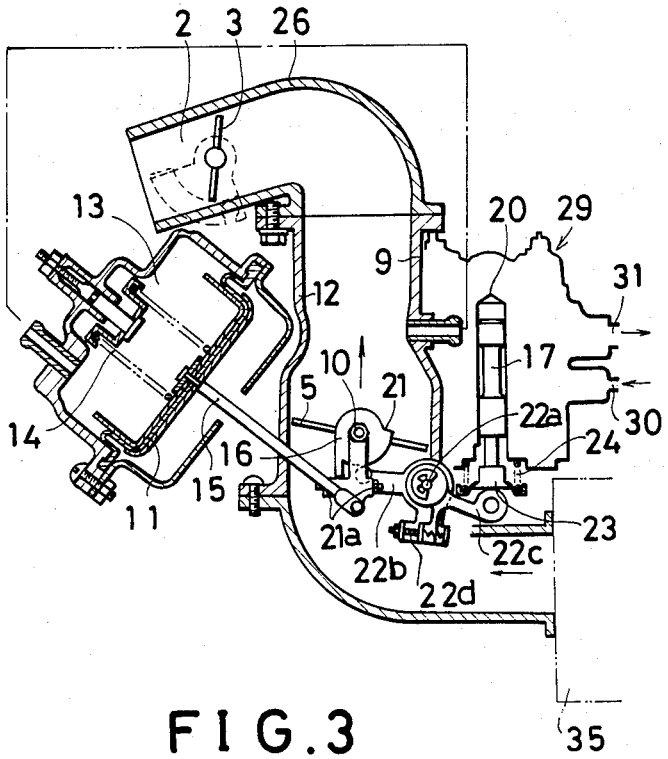
Figure 3:
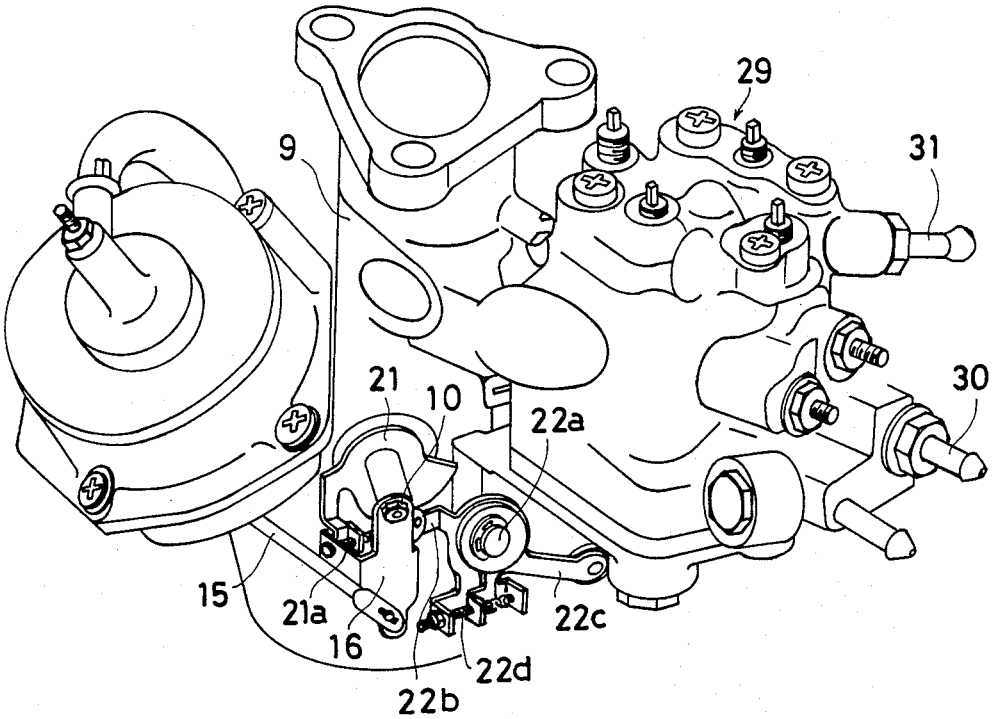

As shown in FIGS. 2 and 3, the foregoing cam 21 is loosely mounted on the turning shaft 10, and the same is connected through an adjusting screw 21*a* to the arm 16 attached to the turning shaft 10, and the lever 22 is formed into a pair of divided levers 22*b*, 22*c* which are mounted in common on the middle shaft 22*a*, and further the two levers 22*b*, 22*c* are interconnected through an adjusting screw 22*d*. Consequently, a relative phase between the air metering valve 6 and the fuel metering valve 7 can be adjusted by means of these adjusting screws 21*a*, 22*b*, so that an air-fuel ratio adjustment on idling and off-idling may be carried out.

Referring to the drawings, numerals 30, 31 denote an inlet said connecting opening and an outlet side connecting opening of the valve block 29 which are connected through a regulator valve 32 and the constant differential pressure valve 27, respectively, to the inlet opening 18 and the outlet opening 19 of the fuel metering valve 17, and numerals 33, 34 denote a filter and an accumulator interposed in the fuel passage 8 portion extending between the inlet side connecting opening 30 and the fuel pump 7, and numeral 35 denotes an air filter connected to a lower side of the valve body 9 of the air metering valve 5.

Thus, according to this invention, the fuel metering valve is formed into a slidable spool valve, and the valve body of the fuel metering valve and the valve body of the air metering valve are arranged in parallel one with another so that the fuel metering valve may be given any desired metering operation according to a profile of a cam mounted on the turning shaft of the air metering valve. Consequently, the apparatus can be smaller in space than that of the previously disclosed one wherein the two metering valves are disposed at right angles one another, and also it becomes possible to accommodate the same in a defined room space in a motorized two-wheeled vehicle or the like.

What is claimed is:

1. A fuel injection apparatus for an internal combustion engine for a motorized two-wheeled vehicle, comprising: an intake passage for an internal combustion, a throttle valve on a downstream side, a fuel injection nozzle connected through a fuel passage to a fuel pump, an air metering valve on an upstream side of the throttle valve and arranged so that, by a negative pressure responsive member arranged to be operated in response to an intake negative pressure at an intermediate portion between the member and the throttle valve, the same may be turned towards its opening side according to increase in the intake negative pressure, said fuel passage having a fuel metering valve which is so arranged that, when the air metering valve is turned towards its opening side, the same may be operated towards its opening side through a lever operating in conjunction with a cam mounted on a rotary shaft of the air metering valve, said fuel metering valve being formed into a slidable type spool valve, a valve body thereof being disposed in parallel with a valve body of the air metering valve, said lever being in engagement, at its one end, with said cam and being swingably supported at its middle portion and being brought in engagement at its other end with a valve rod projecting from one end portion of said fuel metering valve, said apparatus being located below the fuel tank and above the crank case of the engine.

2. A fuel injection apparatus as claimed in claim 1, wherein the valve body of the air metering valve is so arranged as to be raised upright along the side wall of the engine, and the same is connected at its top portion to a cylinder head of the engine.

* * * * *